United States Patent [19]

Buck

[11] Patent Number: 4,619,342

[45] **Date of Patent: * Oct. 28, 1986**

[54] MULTIPLE SOUND TRANSDUCER SYSTEM UTILIZING AN ACOUSTIC FILTER TO REDUCE DISTORTION

[75] Inventor: Marshall D. Buck, Los Angeles, Calif.

[73] Assignee: Cerwin-Vega, Inc., Arleta, Calif.

[ * ] Notice: The portion of the term of this patent subsequent to Aug. 11, 1998 has been disclaimed.

[21] Appl. No.: 433,829

[22] Filed: Oct. 12, 1982

Related U.S. Application Data

[63] Continuation-in-part of Ser. No. 291,425, Aug. 10, 1981, abandoned, which is a continuation of Ser. No. 57,821, Jul. 16, 1979, Pat. No. 4,283,606.

[51] Int. Cl.[4] ..... H04R 7/00; H04R 9/06

[52] U.S. Cl. ..... 181/184; 181/144; 181/166; 179/115.5 H; 179/116

[58] Field of Search ..... 181/144, 148, 155, 156, 181/166, 181–185, 187–189, 196, 295, 145–147, 157; 179/115.5 R, 115.5 PC, 115.5 VC, 115.5 H, 116, 180, 181 R

[56] References Cited

U.S. PATENT DOCUMENTS

| | | | |
|---|---|---|---|
| 2,067,582 | 1/1937 | Sperling | 181/157 |
| 2,107,757 | 2/1938 | Kinsley | 181/144 X |
| 2,295,527 | 9/1942 | Bowley | 181/144 X |
| 2,656,004 | 10/1953 | Olson | 181/157 X |
| 3,061,675 | 10/1962 | MacDonald | 181/157 X |
| 3,584,160 | 6/1971 | Janssen | 181/157 X |
| 4,283,606 | 8/1981 | Buck | 181/144 X |

*Primary Examiner*—Benjamin R. Fuller
*Attorney, Agent, or Firm*—John M. May

[57] ABSTRACT

The present invention relates to acoustic filters for use in combination with a multiple transducer system which includes a low frequency transducer subsystem and a high frequency transducer subsystem each mounted with respect to an axis directed towards the listening environment so as to function acoustically as though having coaxial acoustic centers. Preferably, the acoustic filter is constructed from one or more acoustical elements such as small tubes, narrow slits, perforated baffles, enclosed cavities, and the like combined so as to provide an acoustical impedance which is relatively low for the frequencies produced by the low frequency transducer but which is relatively high for the frequencies associated with the high frequency transducer. The acoustic filter is disposed acoustically between the low frequency transducer and the high frequency transducer so the acoustic filter inhibits the high frequency sounds of the high frequency loudspeaker from being reflected by the low frequency transducer towards the listening environment and thereby results in a noticeable decrease in intermodulation distortion.

15 Claims, 18 Drawing Figures

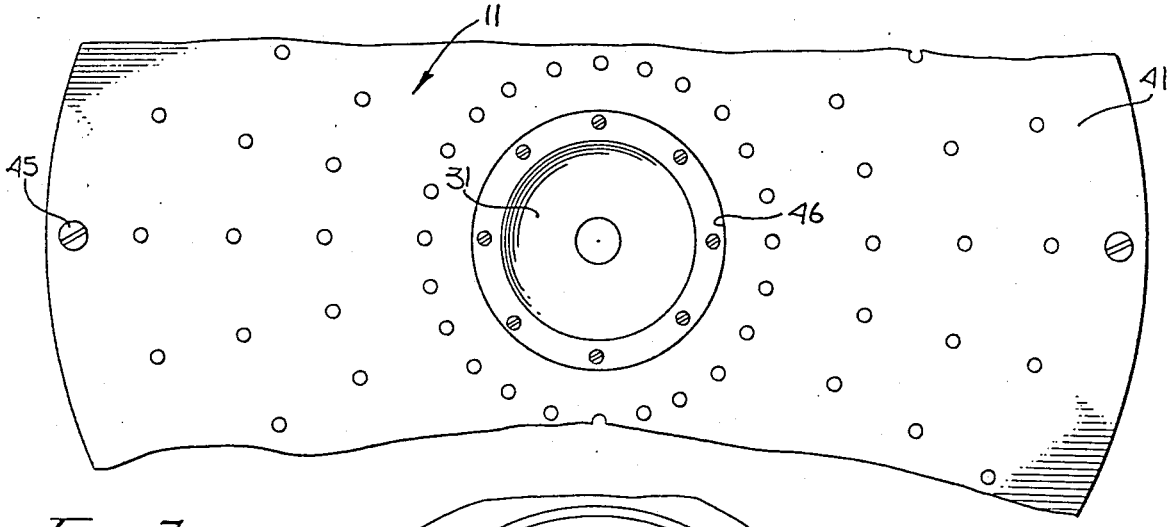
Fig. 3
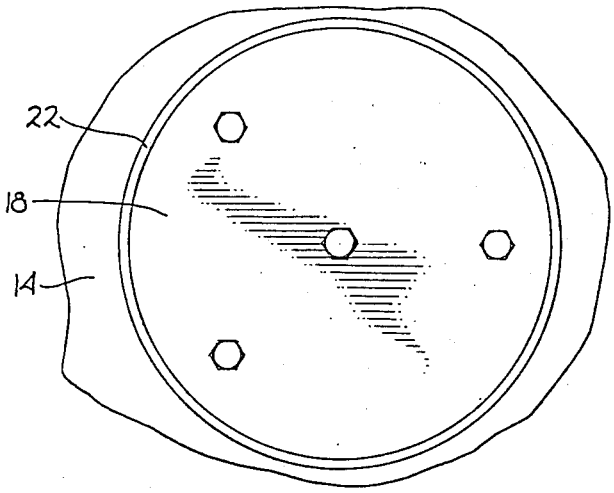
Fig. 4
Fig. 6
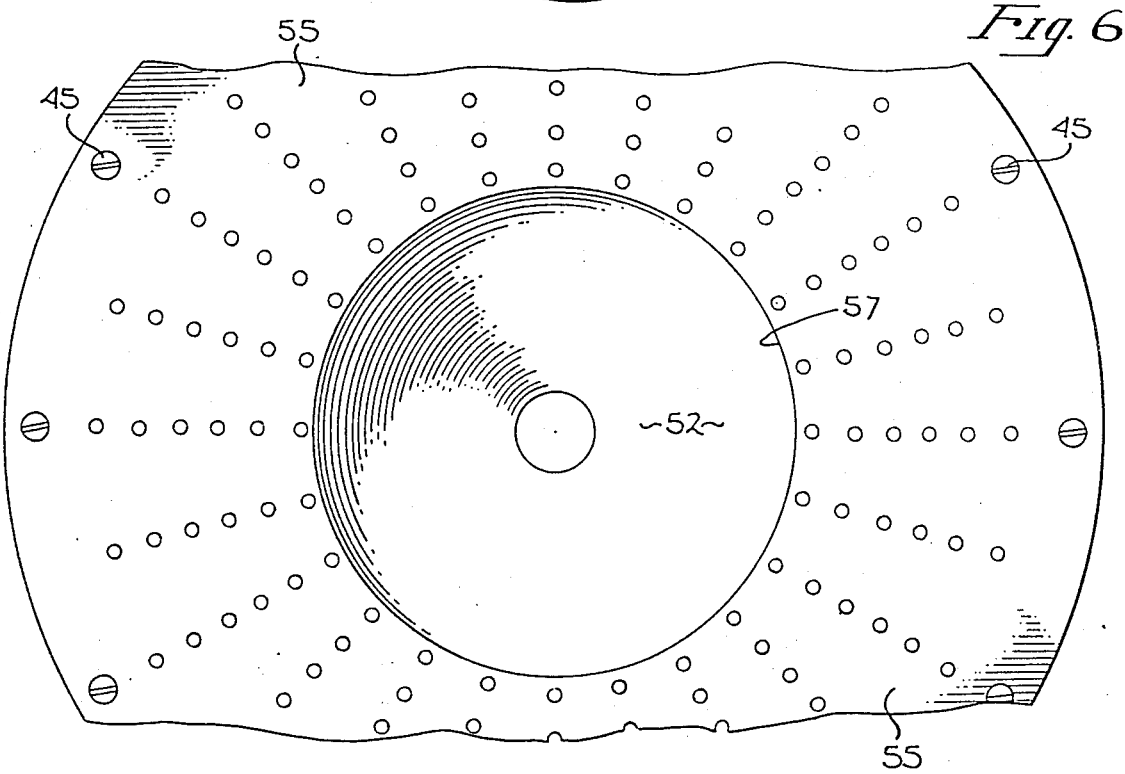

Fig. 7
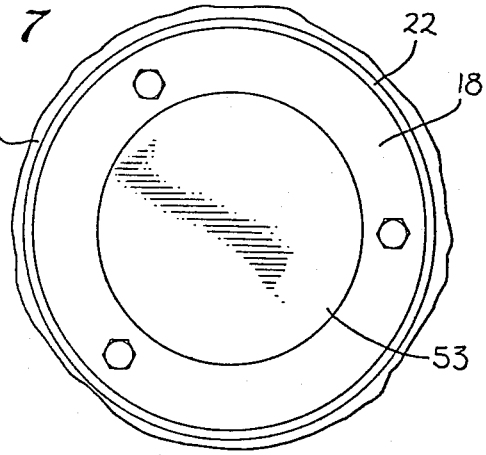
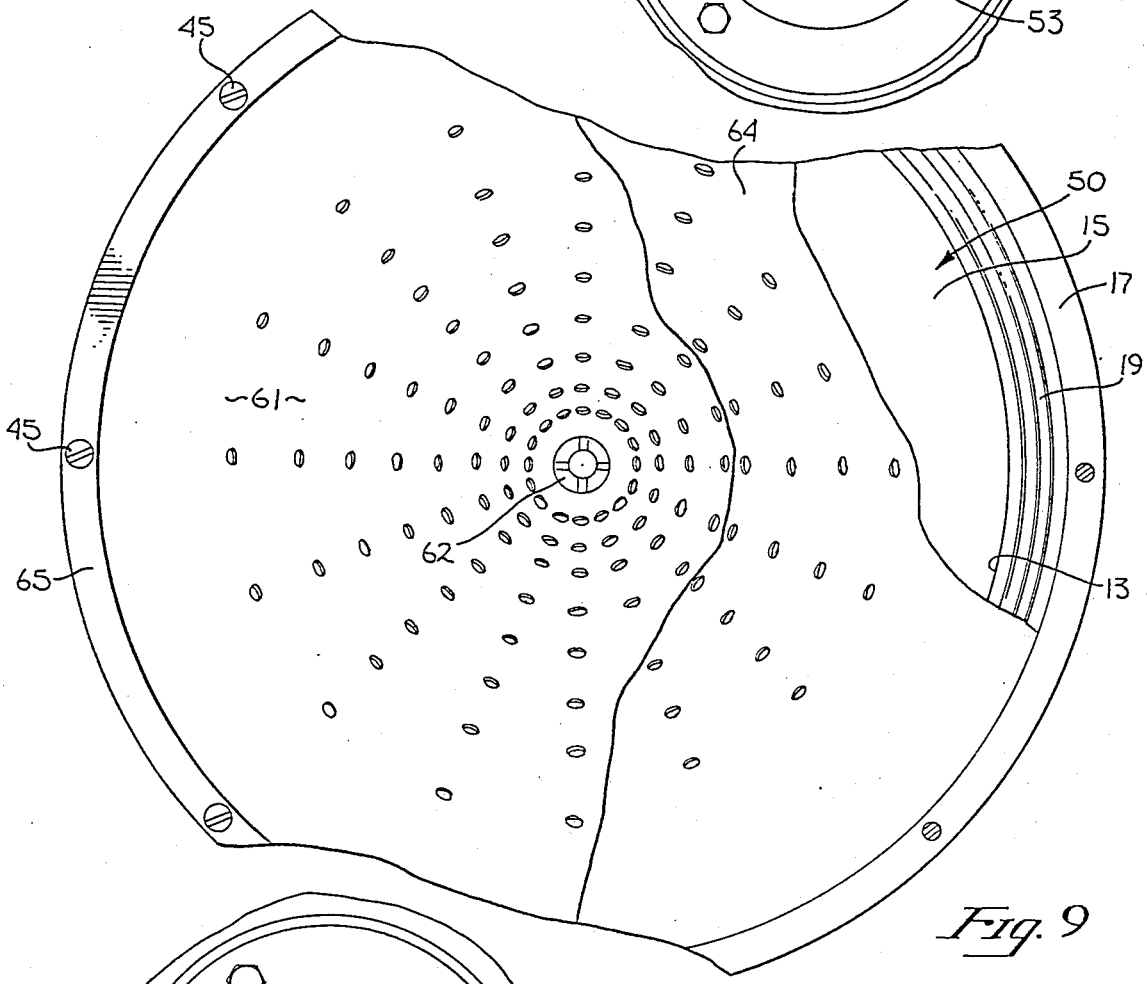
Fig. 9
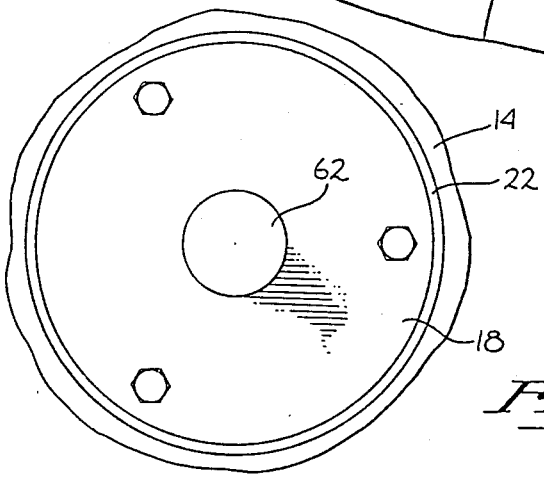
Fig. 10

MULTIPLE SOUND TRANSDUCER SYSTEM UTILIZING AN ACOUSTIC FILTER TO REDUCE DISTORTION

CROSS-REFERENCE TO RELATED APPLICATIONS

This is a continuation-in-part of my prior application Ser. No. 291,425 filed on Aug. 10, 1981 and now abandoned, which in turn was a continuation of my original application Ser. No. 057,821 filed on July 16, 1979, now U.S. Pat. No. 4,283,606 entitled "Coaxial Loudspeaker System".

BACKGROUND OF THE INVENTION

1. Field of the Invention

The present invention relates to multiple transducer loudspeaker systems and more particularly to an improved loudspeaker system which incorporates an acoustic filter to reduce distortion.

2. Description of the Prior Art

U.S. Pat. No. 2,822,884, entitled Loudspeaker Enclosure, issued to Edgar H. Simpson on Feb. 11, 1958, teaches a single speaker cabinet with two acoustic filters and a single speaker.

U.S. Pat. No. 2,866,514, entitled, Corrective Loud Speaker Enclosure, issued to Paul Weathers, on Dec. 30, 1958, teaches a single speaker enclosure with a plurality of chambers which are acoustically coupled to the speaker chamber by acoustic filters.

U.S. Pat. No. 2,067,582, entitled Sound Filter for Loudspeakers, issued to Edward Sperling on Jan. 12, 1937, teaches a sound filter used with only one loudspeaker. The sound filter, when it is applied to the loudspeaker, functions to filter and to clarify the sounds and tones emitted therefrom by minimizing harshness, distortion, static or interference while serving to generally improve the quality of the sounds or tones.

U.S. Pat. No. 2,656,004, entitled Multisection Acoustic Filter, issued to Harry F. Olson on Oct. 20, 1953, teaches a multisection acoustic filter which consists of one or more stages or sections. Each section includes a pair of parallel, perforated sheets or plates separated from each other a suitable distance and joined at their peripheries in any appropriate manner to enclose an air space therebetween. Two such plates constitute a single section filter. A two section filter consists of three such plates, one being common to each section; a three section filter consists of four such plates. These filters may be placed in front of any sound source, such as the loudspeaker of a radio receiver, for example, or in proximity to one or more musical instruments or the like to reduce the high frequency response in each case.

A two-way loudspeaker system is a very practical solution to the problem of building a transducer array that will cover the full audio frequency range. The conventional coaxial arrangement, where the low frequencies are reproduced by a cone loudspeaker of a diameter in the range of twelve to fifteen inches (sometimes called a woofer) and the high frequencies are reproduced by a small cone or horn transducer (sometimes called a tweeter) mounted in front of the larger cone, provides advantages over the spaced woofer-tweeter arrangement in regards to producing an even distribution of sound at angles other than directly on axis. This is due to the closer spacing of the radiating elements. A further advantage in the smoothness of frequency response can be obtained if the tweeter horn is disposed so that it projects through the center pole piece of the low frequency transducer, with the horn continuing forward approximately to the plane of the rim of the woofer. In this configuration the acoustic centers of the two transducers can be arranged to superimpose each other at their crossover frequency by adding a small amount of electrical time delay in the woofer electrical crossover network. The superimposition of the acoustic centers of the two transducers is verified by acoustical phase measurements. The coaxial configuration however, as typically found in commercial loudspeakers has a problem with intermodulation distortion. The audible distortion of the high frequencies radiated by the tweeter is caused by a Doppler shift effect as these high frequencies are reflected off the moving cone surface of the low frequency woofer.

Paul W. Klipsch, in an article entitled "A Note on Modulation Distortion: Coaxial and Spaced Tweeter-Woofer Loudspeaker System", published in the *Journal of the Audio Engineering Society,* Volume 24, Number 3, April, 1976 on pages 186 and 187, discusses the FM distortion of two loudspeaker systems, one of which has a tweeter mounted coaxially with the woofer, and the other has a spaced tweeter-woofer configuration. A loudspeaker radiating high frequencies in close proximity to a loudspeaker radiating low frequencies is observed to be subject to modulation distortion. Thus a tweeter being fed $f_2=9559$ Hz in proximity to a bass speaker radiating $f_1=50$ Hz was found to radiate side frequencies of 9609, 9509, 9659 ($f_2 \pm f_1$, $f_2 \pm 2f_1$, . . .). The sound from the tweeter diffracts around the horn and is reflected by the moving woofer cone, thus producing FM distortion. Klipsch found that clearly audible FM (frequency modulation) distortion of the $f_2$ component of 9559 Hertz was produced by a 50 Hertz, $f_1$, signal of 95 db, sound pressure level in the coaxial arrangement. The total root mean square modulation distortion was 27 decibels below the level of $f_2$.

The magnitude of the FM distortion components which are generated in this manner is determined by the following equation:

$d=0.033A_1f_2k$, where d=total root mean square value of the distortion sidebands as a percent of the amplitude of the higher modulated frequency $f_2$, $A_1$=-peak amplitude of motion in inches at the lower modulating frequency $f_1$, and k=the proportion of high frequency sound which is radiated to the rear of the tweeter and reflected off the moving low frequency cone.

For example, if $A_1=0.25$ inches, f=5000 Hertz, k=0.1 (which is −20 db) and the distortion d=4.1 percent (which is −27.7 db). This degree of distortion would be clearly audible.

A. Stott and P. E. Axon, in their article entitled, "The Subjective Discrimination of Pitch and Amplitude Fluctuations in Recording Systems", published in the *Journal of the Audio Engineering Society,* Volume Five, Number 3, July, 1957 beginning on page 142, discusses the threshold of audibility of frequency modulation distortion of recorded piano program material. Referring to their FIG. 10, it can be verified that 0.4% RMS FM distortion is the audible FM distortion threshold of such musical material.

Furthermore, such FM distortion will also result in additional audible distortion as the higher frequency acoustic energy directed towards the listener is amplitude modulated as a result of the interaction between the FM modulated component reflected off the woofer cone and the unmodulated component radiated directly to the listener from the tweeter.

SUMMARY OF THE INVENTION

In a conventional coaxial speaker a portion of the high frequency sound from the tweeter horn is radiated toward the woofer cone, which is moving and which reflects the high frequency sound, thereby creating a Doppler intermodulation-distortion.

An acoustic low pass filter placed between the horn and the cone, but not between the high frequency transducer and the listener will attenuate the high frequency sound traveling from the horn to the cone and then reflected by the cone to the listening environment thereby reducing the Doppler intermodulation-distortion and thus resulting in a significant reduction in related audible distortion.

As an example, if an acoustic filter of the full section type, which has a cutoff frequency of 2500 Hertz, is fitted between the tweeter and woofer, at 5000 Hertz, the factor k in the example cited above would be reduced by approximately 40 db to 0.001, and the distortion would also be reduced by 40 db to 0.041%. This degree of distortion would be approximately 20 db below audiblity. A full section filter attenuates as much as twenty decibels at one actave above the filter's cutoff frequency and the k factor includes two passes through the filter thereby providing the 40 db reduction.

This distortion reduction afforded by such a filter increases as the frequency $f_2$ increases. Without an acoustic filter the distortion increases in a manner directly proportional to the frequency radiated by the tweeter.

Furthermore, a low pass filter will attenuate the harmonic distortion components which are emanating from the cone at frequencies above the cutoff frequency of the acoustic filter (which in a typical application is designed to be at the same frequency as the electrical cross-over between the woofer and the tweeter).

Although for many applications a low pass filter having a sharply defined cutoff frequency (such as a multi-section low pass filter of the multi-section type) is preferable, a filter comprising a single acoustical element (for example a perforated plate) which provides a more gradual roll off with increasing frequency will still contribute to a measurable improvement in intermodulation distortion and offers the advantages of a relatively simple and inexpensive construction.

In view of the foregoing factors and conditions characteristic of the prior art, it is the primary object of the present invention to attenuate an objectionable form of distortion which is inherent in many loudspeaker systems of the prior art.

It is another object of the present invention to provide for a relatively large horn for a high frequency tweeter, while allowing low frequency sounds from one or more low frequency woofer(s) to pass through the horn which thus functions as a low pass acoustic filter.

In accordance with one embodiment of the present invention, an acoustic filter is used in combination with a low frequency loudspeaker and a high frequency speaker which is disposed acoustically in front of the low frequency loudspeaker. The acoustic filter includes a pair of parallel, perforated sheets which are separated from each other a suitable distance and which are joined together at their peripheries in any appropriate manner so that they enclose an airspace therebetween in order to form a single section low pass acoustic filter. The acoustic filter is disposed acoustically between the low frequency transducer and the high frequency transducer so the acoustic filter will tend to inhibit the high frequency sounds from the tweeter from interacting with the woofer and yet disposed acoustically behind the high frequency transducer so as not to attenuate the undistorted high frequency sounds being radiated directly to the listening environment.

Alternatively, the acoustic filter may comprise but a single perforated sheet, or a baffle provided with acoustically reactant elements such as small diameter tubes or narrow slits, in which the acoustical impedance will increase more or less linearly with frequency above a pre-determined cut-off frequency.

The features of the present invention which are believed to be novel are set forth with particularity in the appended claims.

Other objects and many of the attendant advantages will be more readily appreciated as the same becomes better understood by reference to the following detailed description and considered in connection with the accompanying drawings in which like reference symbols designate like parts throughout the figures.

DESCRIPTION OF THE DRAWINGS

FIG. 3 is a partial top plan view of the coaxial loudspeaker system of FIG. 1 illustrating the acoustic filter thereof.

FIG. 4 is a partial bottom plan view of the coaxial loudspeaker of FIG. 1.

FIG. 6 is a partial top plan view of the coaxial loudspeaker of FIG. 5.

FIG. 7 is a partial bottom view of the coaxial loudspeaker of FIG. 5.

FIG. 9 is a partial, staggered top cross-sectional view of the coaxial loudspeaker of FIG. 8.

FIG. 10 is a partial bottom plan view of the coaxial loudspeaker of FIG. 8.

DESCRIPTION OF THE PREFERRED EMBODIMENT

Figure 1:
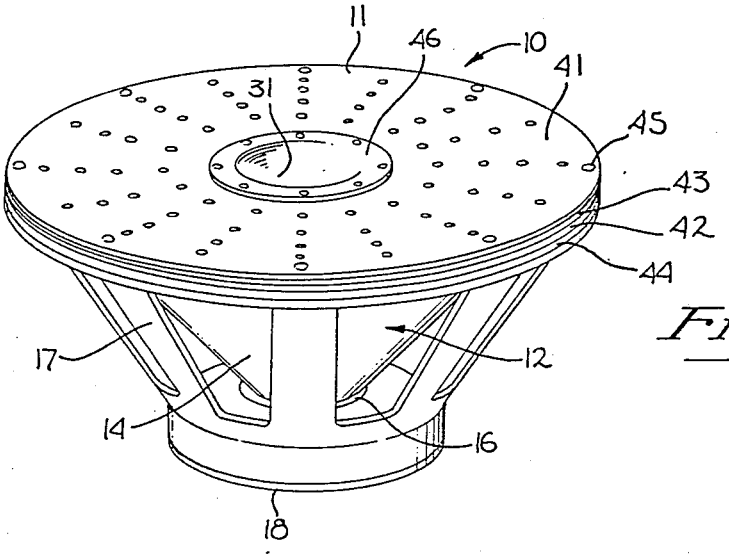
FIG. 1 is a perspective drawing of a coaxial loudspeaker system which incorporates a first embodiment of an acoustic filter which is constructed in accordance with the principles of the present invention.

The present invention can be best understood by reference to a description of various presently preferred embodiments and to the referenced drawings. Referring to FIG. 1 in conjunction with FIG. 2, a coaxial loudspeaker system includes a low frequency loudspeaker 10 which uses an improved acoustic filter 11 in combination therewith. The low frequency loudspeaker 10 includes a conically shaped diaphragm 12 having a front peripheral edge 13, an external sidewall 14, an internal sidewall 15 a base peripheral edge 16, a frame 17 having a conically shaped portion adapted to receive the diaphragm 12, and a back plate 18. The low frequency loudspeaker 10 also includes a surround 19 which mechanically couples the front peripheral edge 13 of the diaphragm 12 to the frame 17.

Figure 2:
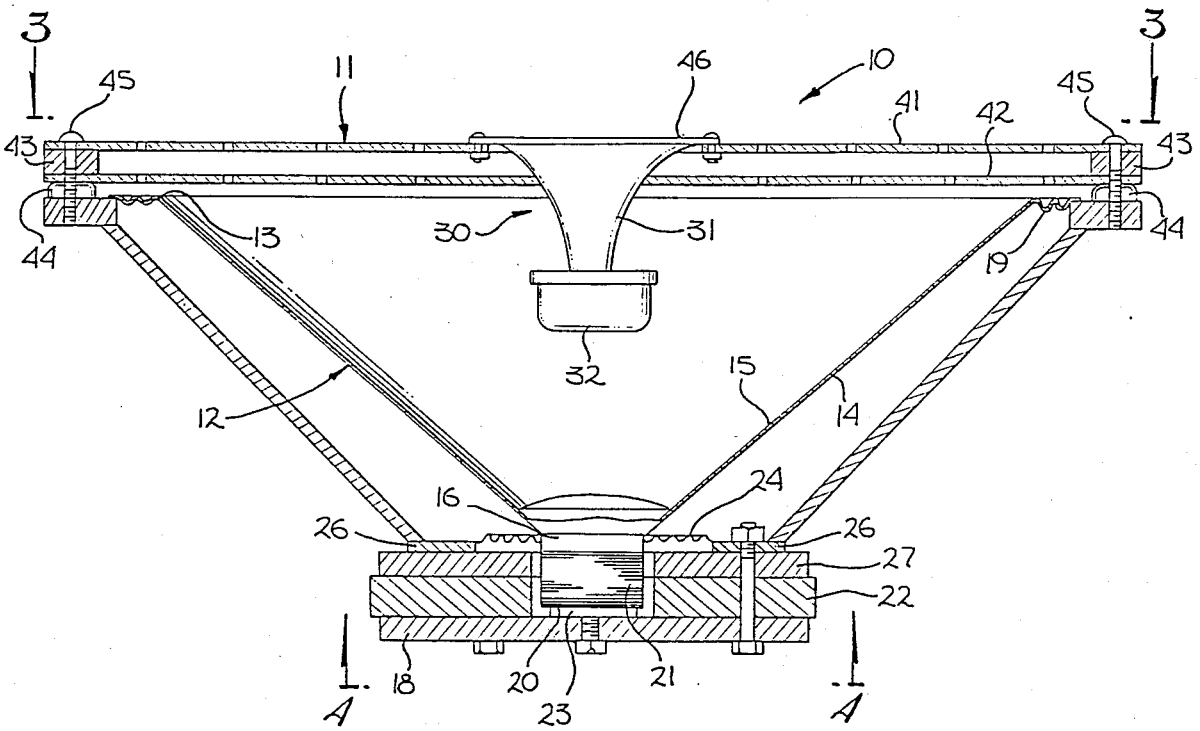
FIG. 2 is an elevational cross-sectional view of the coaxial loudspeaker system of FIG. 1.

Referring still to FIG. 2, the low frequency loudspeaker 10 further includes a cylindrically shaped voice coil member 20 which is mechanically coupled to the base peripheral edge 16 of the diaphragm 12, a voice coil 21 disposed about the voice coil member 20, a ring-shaped magnet 22 and a front plate 27 which are disposed about the voice coil 21 and which are mechanically coupled to the back plate 18, and a cylindrical iron pole piece 23 which is disposed within the voice coil member 20 and which is also mechanically coupled to the back plate 18. The ring-shaped magnet 22, the front plate 27 and the pole piece 23 create a magnetic gap across the voice coil 21.

Still referring to FIG. 2, the low frequency loudspeaker 10 further includes a centering spider 24 which mechanically couples the base peripheral edge 16 of the diaphragm 12 to the base portion 26 of the frame 17. The centering spider 24 centers the voice coil 21 within the magnetic gap.

The coaxial loudspeaker system also has a high frequency loudspeaker 30 which includes a horn 31, a transducer element 32, and circuitry (not shown) for electronically directing the high frequency signals to the high frequency loudspeaker 30 and the low frequency signals to the low frequency loudspeaker 10 in order to provide a smooth crossover between them. The high frequency loudspeaker 30 is disposed in front of the low frequency loudspeaker 10 and is aligned therewith.

Referring to FIG. 1 and FIG. 2 in conjunction with FIG. 3, the improved acoustic filter 11 includes a first perforated sheet 41, a second perforated sheet 42 which is parallelly disposed to the first perforated sheet 41 and separated apart therefrom a suitable distance by a first spacer 43, and a second spacer 44 which separates the second perforated sheet 42 from the peripheral edge of the frame 17. A set of screws 45 secures the first and second perforated sheets 41 and 42 and the first and second spacers 43 and 44 to the frame 17 in order to enclose the airspace between the first and second perforated sheets 41 and 42 and to maintain the second perforated sheets 42 apart from the front peripheral edge 13 of the conically shaped diaphragm 12, the peripheral edge of the frame 17, and the centering spider 24. The improved acoustic filter 11 has an opening 46 for the high frequency loudspeaker 30 and is acoustically in front of the low frequency loudspeaker 10 and acoustically behind the high frequency loudspeaker 30, which is mechanically coupled thereto in order to either eliminate or inhibit the high frequency sounds from the high frequency loudspeaker 30 from interacting with the inner sidewall 15 of the conically shaped diaphragm 12 of the low frequency loudspeaker 10 and thereby creating a Doppler shift in frequency which results in the distortion of the high frequency sounds.

Referring to FIG. 4 in conjunction with FIG. 2, the back plate 18 of the low frequency loudspeaker 10 may be clearly seen.

Figure 5:
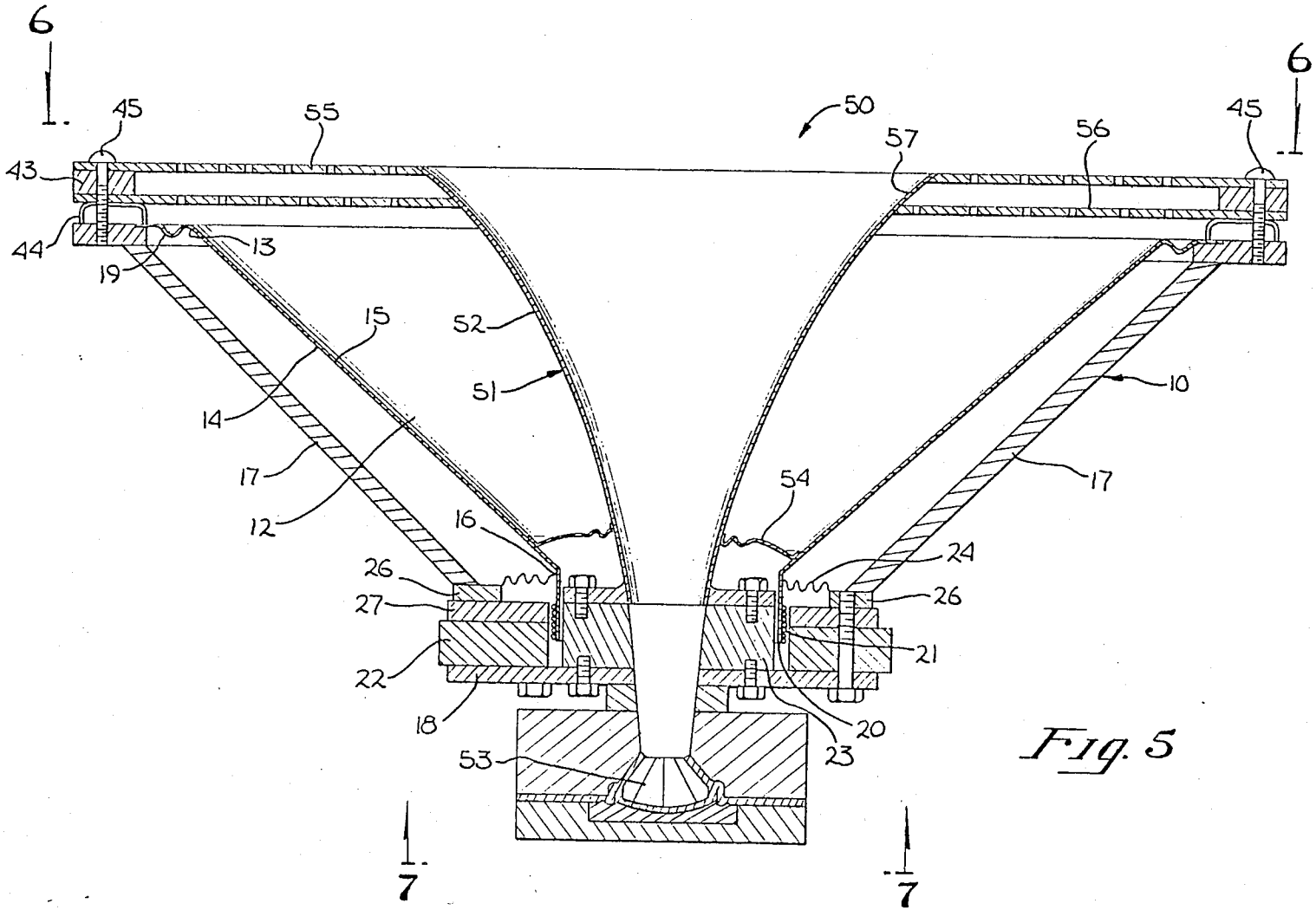
FIG. 5 is an elevational cross-sectional view of a coaxial loudspeaker system which incorporates a second acoustic filter which is constructed in accordance with the principles of the present invention.

Referring now to FIG. 5 in conjunction with FIG. 6, a second embodiment of the present invention is shown in which an acoustic filter is used in a coaxial loudspeaker system which includes a low frequency loudspeaker 50 and a high frequency loudspeaker. The low frequency loudspeaker 50 includes a conically shaped diaphragm 12 having a front peripheral edge 13, an external sidewall 14, an internal sidewall 15 and a base peripheral edge 16 and a frame 17 having a conically shaped portion adapted to receive the diaphragm 12 and a back plate 18. The low frequency loudspeaker 50 also includes a surround 19 which mechanically couples the front peripheral edge 13 of the diaphragm 12 to the frame 17.

Referring still to FIG. 5, the low frequency loud speaker 50 further includes a cylindrically shaped voice coil member 20 which is mechanically coupled to the base peripheral edge 16 of the diaphragm 12, a voice coil 21 disposed about the voice coil member 20, a ring-shaped magnet 22 and a front plate 27 which are disposed about the voice coil 21 and which are mechanically coupled to the back plate 18, and a cylindrical iron pole piece 23 which is disposed within the voice coil member 20 and which is also mechanically coupled to the back plate 18. The ring-shaped magnet 22, a front plate 27, and the pole piece 23 create a magnetic gap across the voice coil 21.

Still referring to FIG. 5, the low frequency loudspeaker 50 still further includes a centering spider 24 which mechanically couples the base peripheral edge 16 of the diaphragm 12 to the base portion 26 of the frame 17. The centering spider 24 centers the voice coil 21 within the magnetic gap.

The coaxial loudspeaker system also has a high frequency loudspeaker 51 which includes a horn 52 and a transducer element 53, and circuitry (not shown) for electronically directing the high frequency signals to the high frequency loudspeaker and the low frequency signals to the low frequency loudspeaker 50 in order to provide a smooth crossover between them. The high frequency loudspeaker 51 is disposed acoustically in front of the low frequency loudspeaker 50 and axially aligned therewith and its transducer element 53 is mechanically supported by the pole piece 23 of the low frequency loudspeaker 50. The low frequency loudspeaker 50 also includes a centering spider 54 which mechanically couples the diaphragm 12 of the low frequency loudspeaker 50 to the horn 52 of the high frequency loudspeaker 51.

Referring again to FIG. 5 in conjunction with FIG. 6, the improved acoustic filter includes a first perforated sheet 55, a second perforated sheet 56, which is parallelly disposed to the first perforated sheet 55 and separated apart therefrom a suitable distance by a first spacer 43, and a second spacer 44 which separates the second perforated sheet 56 from the peripheral edge of the frame 17. A set of screws 45 secures the first and second perforated sheets 55 and 56 and the first and second spacers 43 and 44 to the frame 17 in order to enclose the air-space between the first and second perforated sheets 55 and 56 and to maintain the second perforated sheet 56 apart from the front peripheral edge 13 of the conically shaped diaphragm 12, the peripheral edge of the frame 17 and the surround 19. The improved acoustic filter has an opening 57 for the high frequency loudspeaker 51. The improved acoustic filter is acoustically placed in front of the low frequency loudspeaker 50 and behind the high frequency loudspeaker 51, which is mechanically coupled to the low frequency loudspeaker 50 through the pole piece 23 thereof, in order to either eliminate or inhibit the high frequency signals from the high frequency loudspeaker 51 from interacting with the internal sidewall 15 of the conically shaped diaphragm 12 of the low frequency loudspeaker 50 thereby creating a Doppler shift in frequency which results in the distortion of the high frequency sounds.

Referring to FIG. 7 in conjunction with FIG. 5 the back plate 18 of the low frequency loudspeaker 50 is more clearly seen.

Figure 8:
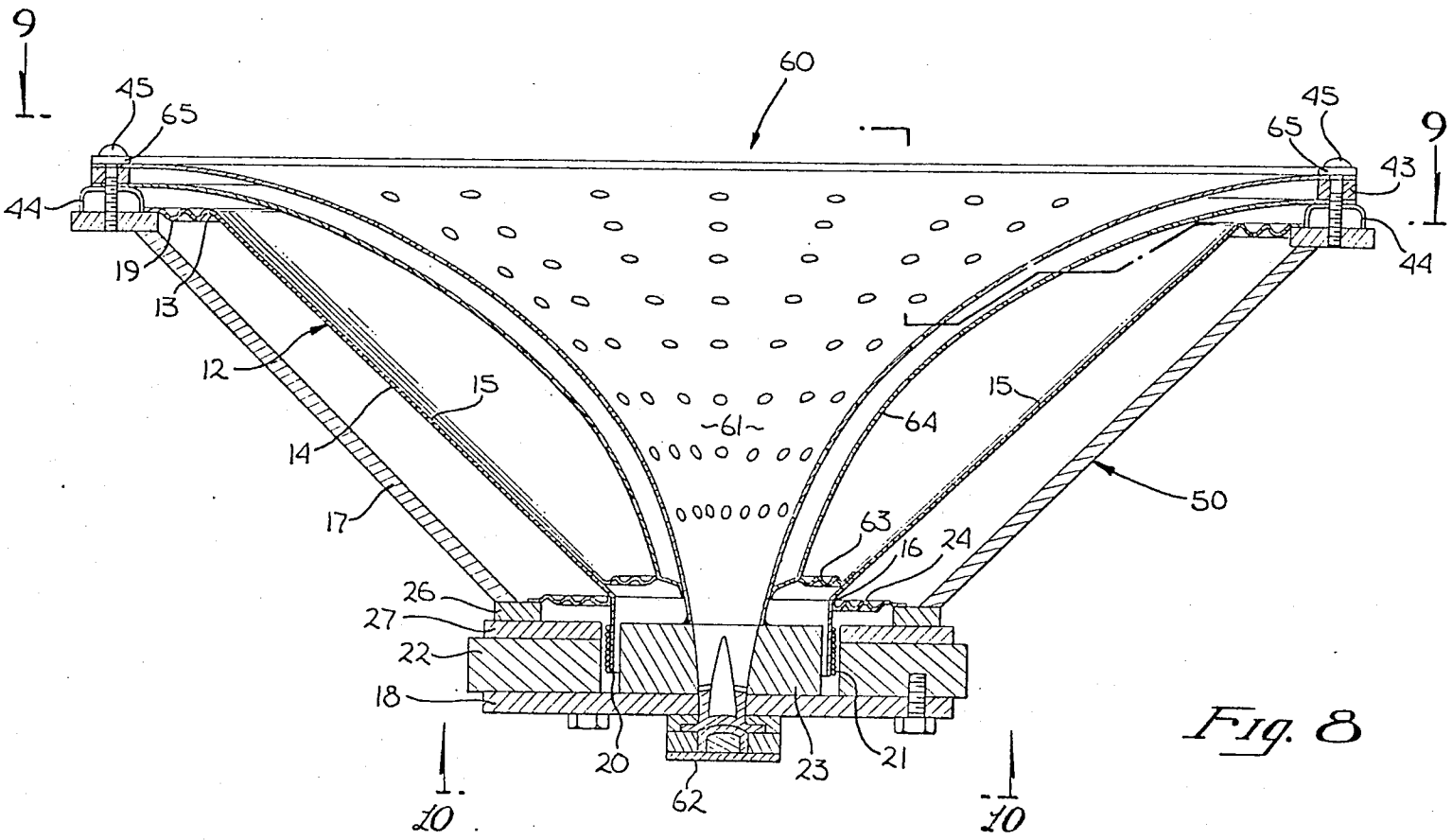
FIG. 8 is an elevational cross-sectional view of a coaxial loudspeaker which incorporates a third embodiment of an acoustic filter which is constructed in accordance with the principles of the present invention.

Referring now to FIG. 8 in conjunction with FIG. 9, a third embodiment of the present invention is an acoustic filter for use in combination with still another coaxial loudspeaker system which includes the low frequency loudspeaker 50 and a high frequency loudspeaker 60 having a first horn 61, a transducer element 62 and circuitry (not shown) for electronically directing the high frequency signals to the high frequency loudspeaker 60 and the low frequency signals to the low frequency loudspeaker 50 in order to provide a smooth crossover between them. The high frequency loudspeaker 60 is disposed in front of the low frequency loudspeaker 50 and axially aligned therewith and its transducer element 62 is supported by the pole piece 23 of the low frequency loudspeaker 50. The low frequency loudspeaker 50 also includes a centering spider 63 which mechanically couples the diaphragm 12 of the low frequency loudspeaker 50 to a second horn 64 which is concentrically disposed within the first horn 61 of the high frequency loudspeaker 60.

Referring still to FIG. 8 in conjunction with FIG. 9, the improved acoustic filter includes the first horn 61 and the second horn 64, which each are formed from a perforated sheet, both of which being separated a suitable distance by a first spacer 43, and a second spacer 44 which separates the second perforated horn 64 from the peripheral edge of the frame 17. A set of screws 45 secures the first and second perforated horns 61 and 64 and the first and second spacers 43 and 44 between a ring 65 and the frame 17 in order to enclose the airspace between the first and second perforated concentrically disposed horns 61 and 64 and to maintain the second horn 64 apart from the front peripheral edge of the conically shaped diaphragm 12, the peripheral edge of the frame 17 and the surround 19. The improved acoustic filter is thus disposed acoustically placed in front of the low frequency loudspeaker 50 and behind the high frequency loudspeaker 60 (which is mechanically attached to the low frequency loudspeaker 50 through the pole piece 23 thereof) in order to either eliminate or inhibit the high frequency sounds from the high frequency loudspeaker 60 from interacting with the internal sidewall 15 of the conically shaped diaphragm 12 of the low frequency loudspeaker 50 which otherwise would create a Doppler shift in frequency which would in turn result in the audible distortion of the high frequency sounds.

Referring to FIG. 10 in conjunction with FIG. 8 the back plate 18 of the low frequency loudspeaker 50 is more clearly seen.

Figure 11:
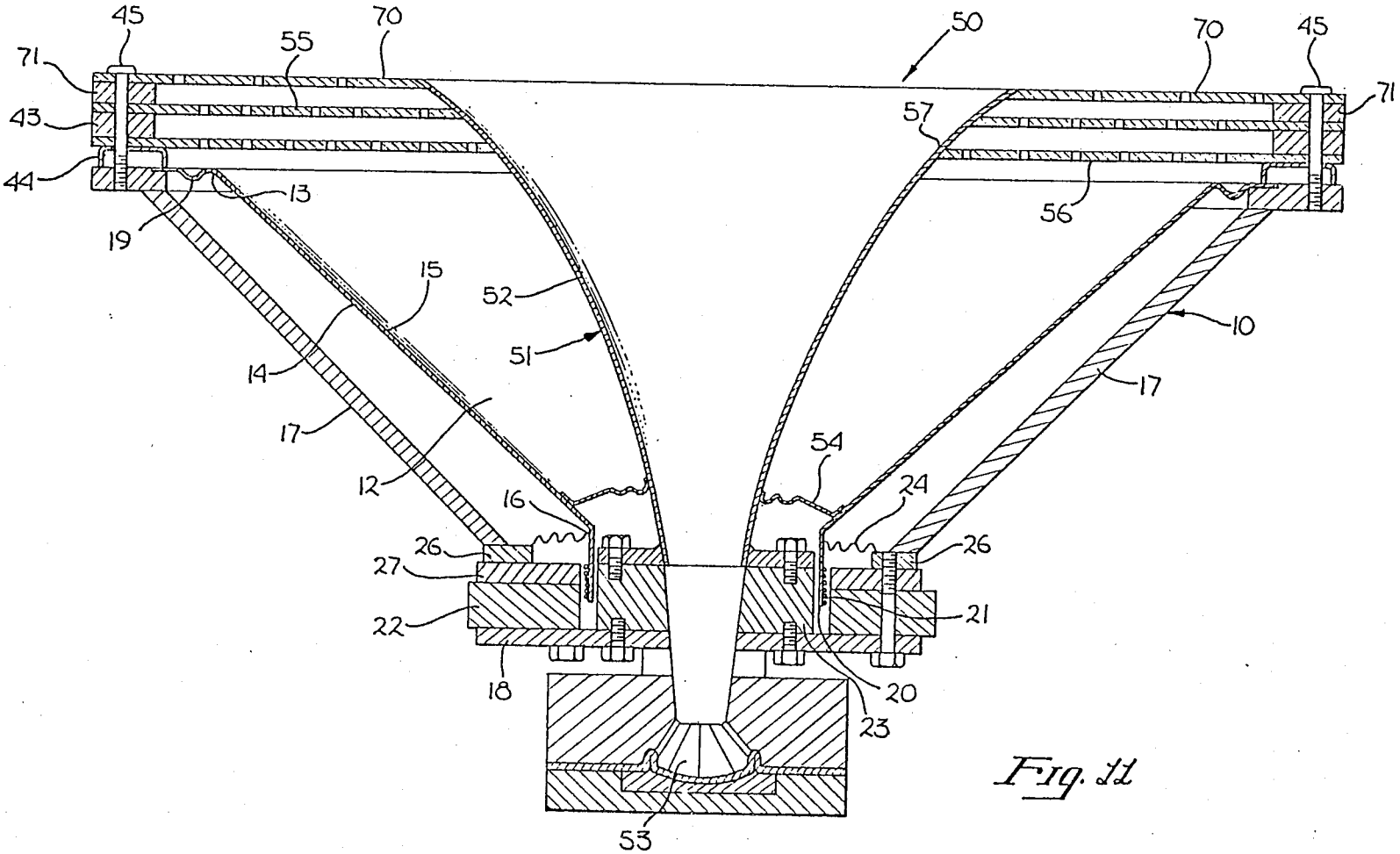
FIG. 11 is an elevational cross-sectional view of a coaxial loudspeaker system which incorporates a third perforated sheet so as to result in a two-section acoustic filter, constructed in accordance with the present invention.

Referring now to FIG. 11, there is shown a fourth embodiment of the present invention in which a two-section acoustical filter is provided between the horn 51 of the high frequency subsystem and the outer periphery 19 of the low frequency transducer coaxial therewith. In particular, this improved two section acoustic filter includes the first perforated sheet 55, a second perforated sheet 56 disposed in parallel to the first sheet 55 and separated therefrom by means of a suitably dimensioned spacer 43. A second spacer 44 separates the second perforated sheet 56 from the frame 17 located about the periphery of the low frequency woofer cone 14. There is also provided a third perforated sheet 70 disposed in parallel to the first perforated sheet 55 and the second perforated sheet 56, being separated therefrom by means of a third spacer 71.

Figure 12:
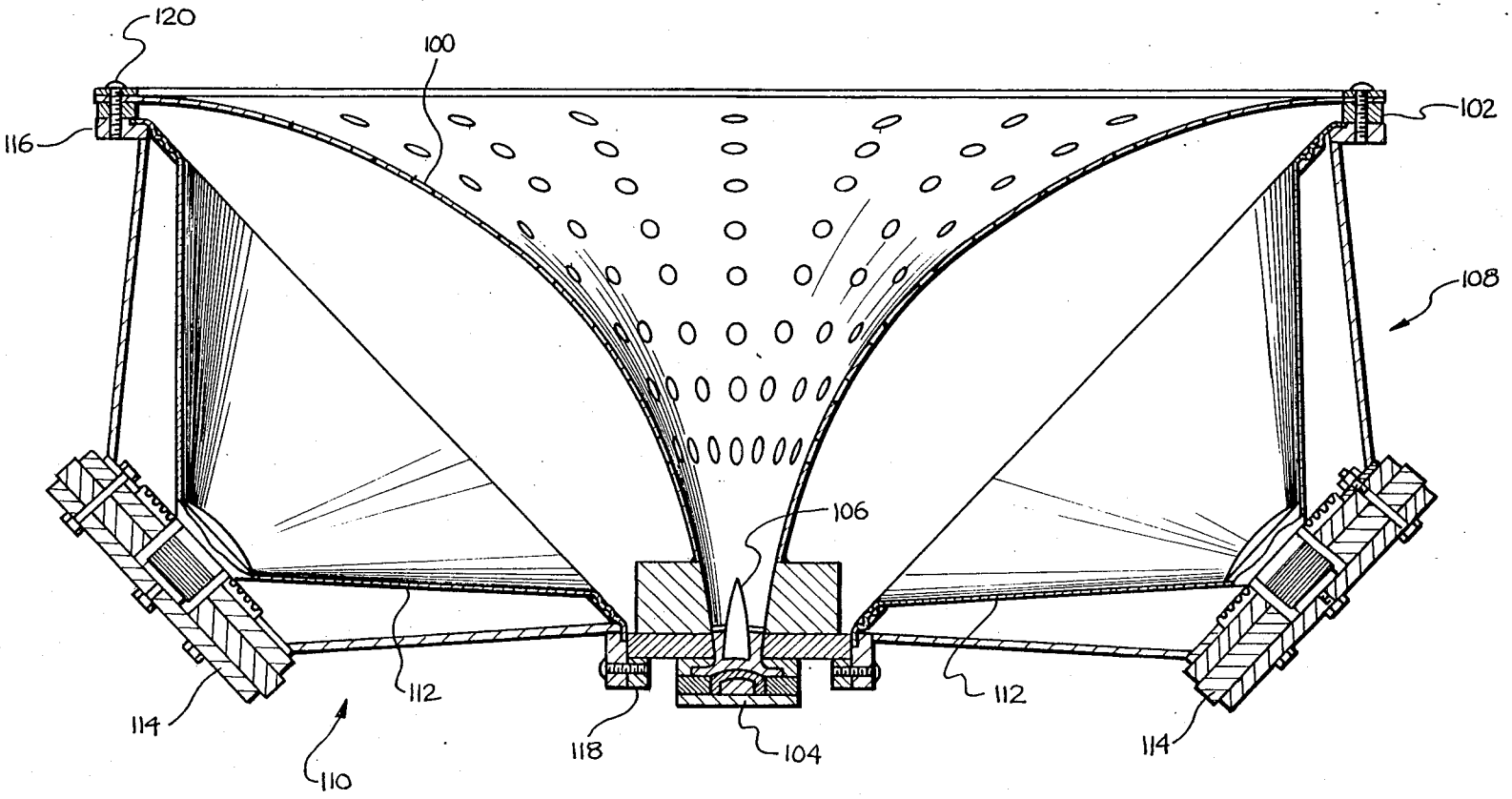
FIG. 12 is an elevational cross-sectional view of a loudspeaker system constructed in accordance with the present invention, the acoustic filter shown in this figure being constructed from a single perforated sheet, and the low frequency subsystem employing a plurality of low frequency transducers arranged about a common axis such that their combined low frequency output is effectively coaxial acoustically with the system's high frequency output.

Reference should now be made to FIG. 12 which shows another embodiment of the present invention differing from the above-described embodiments principally in that (a) rather than utilizing a relatively complex low pass acoustic filter having a very sharp cut off (such as when an enclosed air space is provided between parallel perforated sheets) it utilizes a rather simple type of acoustical filter formed from a single perforated plate that will nevertheless present a sufficiently high impedance to the high frequency acoustic emissions from the high frequency driver 104 and at the same time a sufficiently low impedance to the lower frequency acoustic emissions from the low frequency transducers and (b) rather than utilizing but a single low frequency woofer mounted coaxially with respect to the high-frequency transducer 104, there is provided a pair of woofers 108, 110 symmetrically disposed about the acoustic axis 106 of the high frequency driver 104 so as to result in a more compact arrangement. In the embodiment only two such woofers are employed; however, it will be obvious to the skilled artisan that it is also possible to arrange more than two such woofers symmetrically about the axis 106 such that the combined low frequency output from the woofers is the acoustic equivalent of a single acoustic source that is in effect coaxial with the source of high frequency acoustic emissions provided by the high fequency transducer 104. In such a compact arrangement it will be appreciated that the cone 112 of each woofer 110 is physically quite close to the high frequency acoustic emissions being projected along the general direction of axis 106 by the high frequency transducer 104, and thus the low pass characteristics of the acoustic filter 100 will result in a significant reduction in audible distortion that would otherwise result from the modulation of the high frequency emissions generated by the high frequency transducer in the event that a significant portion of the high frequency output were reflected by the moving woofer cone 112 (and thus shifted in frequency and phase) and then redirected towards the listening environment where they would be combined with the direct acoustic emissions from the high frequency transducer. In the embodiment shown, the individual woofer 110 is attached at one side by means of a first bracket 116 to a supporting baffle 102 of a conventional speaker enclosure and at its other side by means of a second bracket 118 to the frame of the high frequency transducer 104. Although not visible in the cross-sectional elevational view of the Figure, a suitable baffle may be provided about the entire periphery of each woofer 108 and 110 so as to eliminate any acoustical leakage between the front and rear surfaces of the low frequency cone 112. In that event, those portions of the surface of the acoustic filter 100 which do not communicate directly with the front surface of cone 112 should be acoustically opaque or at least have a relatively high acoustic resistance at the low frequencies associated with the woofer 110, while the acoustic filter characteristics of those portions of the acoustic filter 110 directly in front of the woofer cone 112 should be relatively transparent to the low frequency sound emissions generated thereby. Of course, rather than employing two or more woofers 110 and 108, a single low frequency woofer physically coaxially located to the rear of the high frequency transducer such as shown in the embodiment of FIG. 2, or alternatively (if the driver portion of the low frequency transducer is annular in shape) then the low frequency driver may be mounted circumferentially about the rear portion of the high frequency horn such as shown in FIG. 8, in the latter event, essentially the entire surface area of the filter 100 may be perforated or otherwise provided with a low band pass characteristic, since the low frequency woofer cone will be acoustically behind the entirety of the filter 100. As used herein the expressions "acoustically in front of" and "acoustically behind" are with reference to a listener in the listening environment and accordingly an acoustic filter is acoustically in front of a low frequency transducer if the majority of the latter's acoustic emissions directed at the listener must first pass through the filter, and the acoustic filter is behind the high frequency transducer if the majority of the acoustic emissions from the high-frequency transducer are free to radiate directly towards the listener without first being subjected to the filtering effects of the filter.

Figure 13:
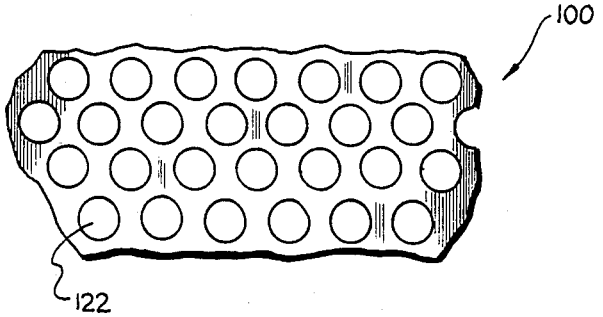
FIG. 13 is a plan view of a portion of the single plate acoustical filter of FIG. 12.
Figure 14:
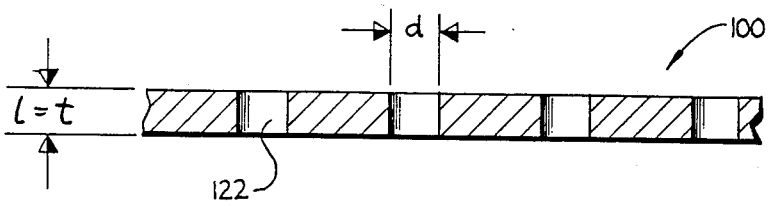
FIG. 14 is a cross-sectional view through a portion of a first embodiment of a single plate acoustical filter.
Figure 15:
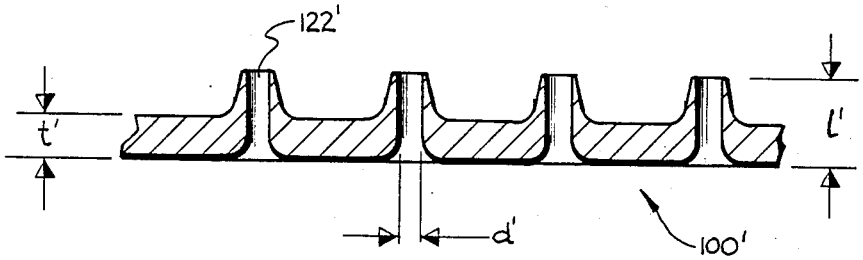
FIG. 15 is a cross-sectional view through a portion of a second embodiment of a single plate acoustical filter.
Figure 16:
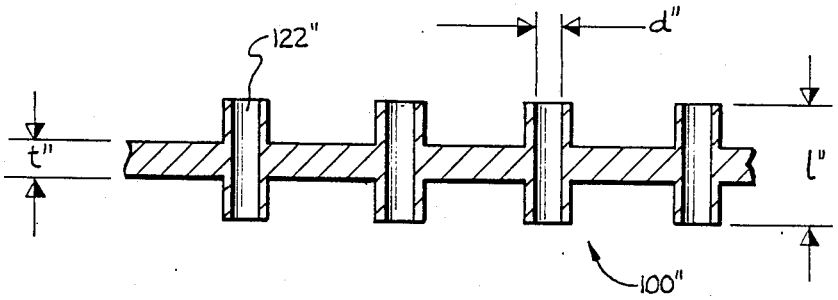
FIG. 16 is a cross-sectional view through a portion of a third embodiment of a single plate acoustical filter.

Reference should now be made to FIG. 13 in conjunction with FIGS. 14 through 16, which are respectively a plan view and cross-sectional view through three different embodiments of a simple perforated plate type of acoustical filter (or a perforated plate element for a more complex acoustic filter constructed from several acoustic elements.)

Referring first of all to FIG. 13 it will be seen that the individual peforations 122 are arranged in alternating rows. Such an arrangement permits the individual perforations to be spaced closely together. Since the acoustic filter 100 is positioned between the low frequency transducer and the listener and since the low frequency transducer would normally be the critical component for determining the maximum acoustic power that can be handled by the entire system, it will be apparent that it is normally desirable to maintain the total acoustical impedance associated with a filter at as low a value as possible, at least at the lower frequencies. However, the acoustic resistance component of the filter is determined by its overall openness. Accordingly, the closer the individual perforations are located with respect to each other, the lower the insertion losses associated with the filter. On the other hand, in order to maintain the effective cut-off frequency within the desired region, it will frequently be necessary to utilize a perforated plate in which the perforations comprise less than 35% of the total area.

In accordance with chapter 5 of the treatise entitled Acoustical Engineering by Harry F. Olson published by D. Van Nostrand Co. Inc. 1957, the acoustical impedance of a small tube having an effective length "l" and an effective diameter "d" is given by the formula:

$$z_A = \frac{128 \cdot \mu \cdot l}{\pi \cdot d^4} + j \cdot \frac{32 \cdot \rho \cdot l \cdot f}{3 \cdot d^2}$$

in which the real part of the expression is termed the acoustical resistance and the imaginary part of the expression is termed the acoustical inertance. It will be observed that the acoustical resistance associated with the tube is independent of frequency and that the inertance term increases as frequency increases. As is explained in the referenced treatise, practically any ratio of inertance to acoustical resistance may be obtained by appropriate selection of the value "d", the above-stated formula being accurate for those acoustic frequencies having a wave length that is relatively large compared to d and l. Accordingly, the effective cut-off frequency may be determined by an appropriate choice of values for d and l and by the spacing between adjacent perforations (i.e., by the percentage of open area).

In the FIG. 14 embodiment of such acoustical element, it will be seen that the individual tubes are formed by perforating a plate having a thickness l by punching or drilling; alternatively the holes may be formed integrally with the plate itself by means of diecasting or the like. In either event the length l of the acoustic tube is the same as the thickness "t" of the plate.

FIG. 15 illustrates an alternative embodiment of an acoustical filter plate in which the length l′ of an individual small tube opening 122′ is significantly longer than the average thickness t of the plate. The individual openings 122′ may be formed by a combined punching and drawing operation such as is conventionally employed to produce a cheese grater or the like. Such a form of construction is particularly suitable when it is desired for reasons of cost and weight to make the plate of a relatively thin material but in which for acoustic reasons the effective length of the individual perforated openings should preferably be longer than the average thickness of the plate material being utilized.

Referring now to FIG. 16, which it will be recalled is a third embodiment of a perforated acoustic filter element, there may be achieved an even longer effective length l″ of the individual small tubes relative to the thickness t of the supporting plate by forming the individual tubes 122″ as hollow cylinders pressed into or integrally formed with the supporting plate so as to project from one or both sides thereof.

Figure 17:
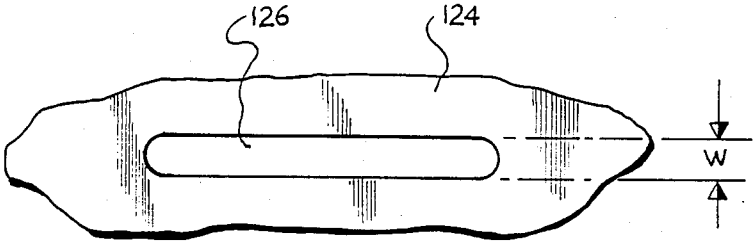
FIG. 17 is a plan view of a portion of a second type of simple acoustical filter employing slits as the transmission elements.
Figure 18:
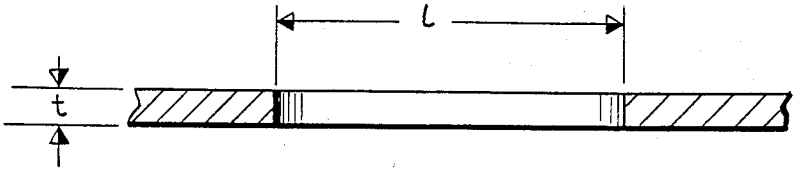
FIG. 18 is a cross-sectional view through the slitted plate of FIG. 17.

FIGS. 17 and 18 show yet another alternative embodiment of an acoustical filtering element in which a number of narrow slits 126 are provided, each slit having an effective width "w" and length "l", the slits being provided in a plate of thickness "t". In accordance with the formula provided by Olson's Treatise:

$$z_A = \frac{12 \cdot \mu \cdot t}{l \cdot w^3} + j \cdot \frac{12 \cdot \pi \cdot \rho \cdot t \cdot f}{5 \cdot l \cdot w}$$

From this formula it may be seen that the resistance term varies inversely as the cube of w while the inertance varies merely inversely as w. The cut-off frequency and overall efficiency (acoustic conductivity) of the filter may be determined by the appropriate selection of values for w, l, and t, and by the spacing between adjacent slits.

Although specific configurations of acoustical elements have been described in detail above, it will be apparent to one skilled in the art that other forms of construction of an acoustical filter may be utilized in achieving the objectives of the present invention. Furthermore, it should be understood that the action of the acoustic filter may be enhanced or complemented by appropriate design of any electronic cross-over circuit utilized therewith.

From the foregoing it can be seen that certain specific embodiments of an improved multiple sound transducer system utilizing an acoustic filter in combination with conventional coaxial loudspeaker system components have been described. The primary advantage of this combination is the considerable reduction in the audible distortion of high frequency sounds compared to what would normally result from the interaction between the tweeter and woofer of a conventional coaxial loudspeaker system.

Accordingly, it is intended that the foregoing disclosure and the showing made in the referenced drawings shall be considered only as illustrative of the underlying generic invention. Furthermore it should be noted that the sketches are not drawn to scale and that dimensions of and between the various figures are not to be considered significant. The invention in its various generic and specific aspects will be set forth with particularity in the appended claims.

I claim:

1. An improved multiple source sound transducing system comprising:

first transducing means for providing a first source of low frequency acoustic energy directed towards a listening environment;

second transducing means for providing a second source of high frequency acoustic energy, said second source and said first source having respective acoustic centers acoustically oriented coaxially along an axis oriented towards said listening environment; and an acoustic filter comprising a baffle member having a higher acoustic impedance at higher acoustic frequencies relative to its impedance at lower acoustic frequencies, said baffle member being acoustically disposed between said first transducing means and said second transducing means and also being acoustically disposed between said first transducing means and said listening environment, whereby said baffle member will tend to attenuate the higher frequency acoustic energy from said second transducing means as it is propagated towards said first transducing means and to further attenuate that portion of said higher frequency acoustic energy reflected by said first transducing means towards said listening environment.

2. The multiple source sound transducing system of claim 1, wherein said baffle member additionally functions to direct the acoustic energy from said second transducing means towards said listening environment.

3. The system of claim 1 wherein said baffle member is sufficiently acoustically transparent at lower frequencies to pass a substantial portion of the low frequency acoustic energy generated by said first transducing means and which is sufficiently acoustically opaque at higher frequencies to inhibit a substantial portion of frequencies higher than said lower frequencies.

4. The system of claim 1 wherein said baffle member comprises a plurality of small tubes for providing an acoustic path between said first transducer and said listening environment having sufficient acoustic inertance to provide a noticeably greater acoustic impedance at the higher frequencies associated with said second transducing means compared with the lower frequencies associated with said first transducing means.

5. The system of claim 4 wherein said baffle member consists of a perforated plate with the individual perforations in said plate functioning as said tubes, the effective diameter of a particular such tube being determined by the cross-sectional size and shape of the corresponding perforation.

6. The system of claim 5 wherein said peforations are round.

7. The system of claim 5 wherein each such peforation is of any geometrical shape and said effective diameter is the diameter of a small circular tube having substantially the same acoustic characteristics as said such perforation.

8. The system of claim 5 wherein the effective length of said particular tube is determined by the thickness of said plate.

9. The system of claim 5 wherein said perforations are formed as perforated dimples in said plate whereby said effective length may be significantly longer than the average thickness of said plate.

10. The system of claim 5 wherein said perforations are defined within respective cylindrical bodies projecting beyond the surface of said plate, whereby the effective length of said tubes may be determined independently of the thickness of said plate.

11. The system of claim 1 wherein said baffle member comprises a plate having a plurality of narrow slits, the width of each such slit being small compared to the wavelength of acoustic energy associated with said first transducing means so as to provide an acoustical element that will selectively pass acoustical energy having a relatively low frequency spectrum.

12. The system of claim 1 wherein said baffle member comprises a single section filter defined by a pair of perforated plates spaced apart from each other.

13. The system of claim 2 wherein said baffle member comprises a single section filter defined by a pair of perforated plates spaced apart from each other.

14. The system of claim 1 wherein said baffle member comprises of a double section filter comprising three perforated plates spaced apart from one another.

15. The system of claim 5 wherein the average open area of said plate is less than 35%.

* * * * *